United States Patent [19]

Rutherford et al.

[11] Patent Number: 4,527,928

[45] Date of Patent: Jul. 9, 1985

[54] PROTECTIVE RISER-CONDUCTOR FOR OFFSHORE STRUCTURES

[75] Inventors: David A. Rutherford, New Orleans; Gerard P. Albers, Covington, both of La.

[73] Assignee: Texaco Inc., White Plains, N.Y.

[21] Appl. No.: 514,077

[22] Filed: Jul. 15, 1983

[51] Int. Cl.[3] ..... E02D 5/60

[52] U.S. Cl. ..... 405/211; 405/195

[58] Field of Search ..... 405/211, 216, 195, 212; 114/220, 219; 166/350, 359, 367

[56] References Cited

U.S. PATENT DOCUMENTS

| | | | |
|---|---|---|---|
| 2,181,526 | 11/1939 | Upton | 405/216 |
| 3,180,099 | 4/1965 | Mikolajczyk et al. | 405/216 |
| 3,271,963 | 9/1966 | Blenkarn | 405/211 |
| 3,283,515 | 11/1966 | Pottorf | 405/211 |
| 3,541,800 | 11/1970 | Walker et al. | 405/211 |
| 3,939,665 | 2/1976 | Gosse et al. | 405/216 |
| 4,040,264 | 8/1977 | Neilon | 405/195 |
| 4,332,509 | 1/1982 | Reynard et al. | 405/195 X |
| 4,462,717 | 7/1984 | Falcimaigne | 405/224 X |

*Primary Examiner*—Dennis L. Taylor

*Attorney, Agent, or Firm*—Robert A. Kulason; Robert B. Burns

[57] ABSTRACT

A protective sleeve for fitting about the periphery of the leg of an offshore structure. The sleeve comprises means for carrying and enclosing a plurality of conductors. It further includes one or more inner rings; an outer jacket is fixedly spaced from the rings to define longitudinal passages within which the respective conductors are fixedly positioned. The sleeve is capable of deflecting packed ice and floating objects which represent possible sources of damage to the structure or to conductors.

7 Claims, 3 Drawing Figures

PROTECTIVE RISER-CONDUCTOR FOR OFFSHORE STRUCTURES

BACKGROUND OF THE INVENTION

Structures or platforms which are positioned in a body of water, usually at an offshore location, are utilized for a number of functions. For one thing, they are used for drilling wells into the substrate beneath the structure to locate and produce hydrocarbons such as crude oil, gas and the like. These structures find use in virtually any depth of water. However, they are found to be most practical up to and including at least 1,000 feet of water.

Such structures are not only utilized for drilling new wells into a known hydrocarbon containing reservoir; they can also be used for the ancillary purpose of collecting hydrocarbons from a number of dispersed wells. Further, they find use as stations for treating the hydrocarbons before they are pipelined or shipped to a remote point.

In the instance of a platform utilized to gather or accumulate the production of a number of scattered wells, the platform normally contains equipment for initially treating the crude oil and/or the gas which is received. This treatment, although preliminary to the actual refining or storage steps, is such that the oil or gas is retained only provisionally before being passed on to a tanker or to an inshore pipeline.

When the platform is used as a gathering point for a number of dispersed wells, it is normally provided with a series of conductors which extend downwardly from the platform deck, and into the substrate. Thus, as the various pipelines are channeled into the offshore structure, they are connected with one of the latter's conductors whereby liquid crude, or gas can be pumped directly up into the platform's holding tanks.

These downwardly extending conductors from the deck serve a number of functions. They are used, for example, to conduct water and other fluids, as well as for enclosing electrical lines and cables which must extend from the platform deck to various well heads.

It is sometimes desirable to position the conductors internally of a platform leg since the latter would act as a natural support for the relatively small and fragile conductors. However, in that the conductors must eventually extend outwardly through the leg wall, it becomes necessary to form passages or openings for them to pass through.

One way of furnishing the leg with suitable accommodations, is to place them with diver assistance after the leg has been installed. Thus, during the installation of any offshore platform of the type under consideration, the piles or legs are individually driven in a generally upright position to a desired depth into the substrate. After the proper number of support piles or legs have been installed, the deck section is lowered into place and fastened.

In the presently disclosed arrangement, after the support piles have been forced into place, one or more of them are provided with an outer protective shield. The latter is lowered into place in such a manner that it will be properly positioned to engage ice or other floating objects regardless of the level of the water in response to tidal changes thereby to protect both the leg and the conductors.

In the disclosed arrangement, an offshore structure is provided which is normally installed in a body of water at an inland site or in a tidal area. The structure, as noted, can embody a deck or superstructure which holds means for drilling wells or for merely functioning to gather flows of oil, gas, or both from incoming pipelines and remote well heads.

The deck is supported beyond the surface of the water by at least one, and preferably a plurality of legs or piles. One or more of the latter carries an external sleeve in such a manner that floating objects, as they near the leg, will be contacted by the protective sleeve. Thus, neither the leg itself nor conductors which are disposed about the leg periphery will suffer damage.

It is therefore an object of the invention to provide a platform or offshore structure particularly adapted for use in an environment where ice is found to be prevalent for at least a part of the year. A further object is to provide a platform of the type contemplated which embodies external protection from floating material which might come into damaging contact with the platform support members. A still further object is to provide an offshore structure support leg which is particularly adapted to resist damage which might result through contact with floating objects or similar materials.

DESCRIPTION OF THE DRAWINGS

Referring to FIG. 1, a marine or offshore structure 10 of the type presently contemplated is shown as comprising primarily a deck 11 which is normally positioned 30 to 60 feet above the water's surface.

Figure 1:
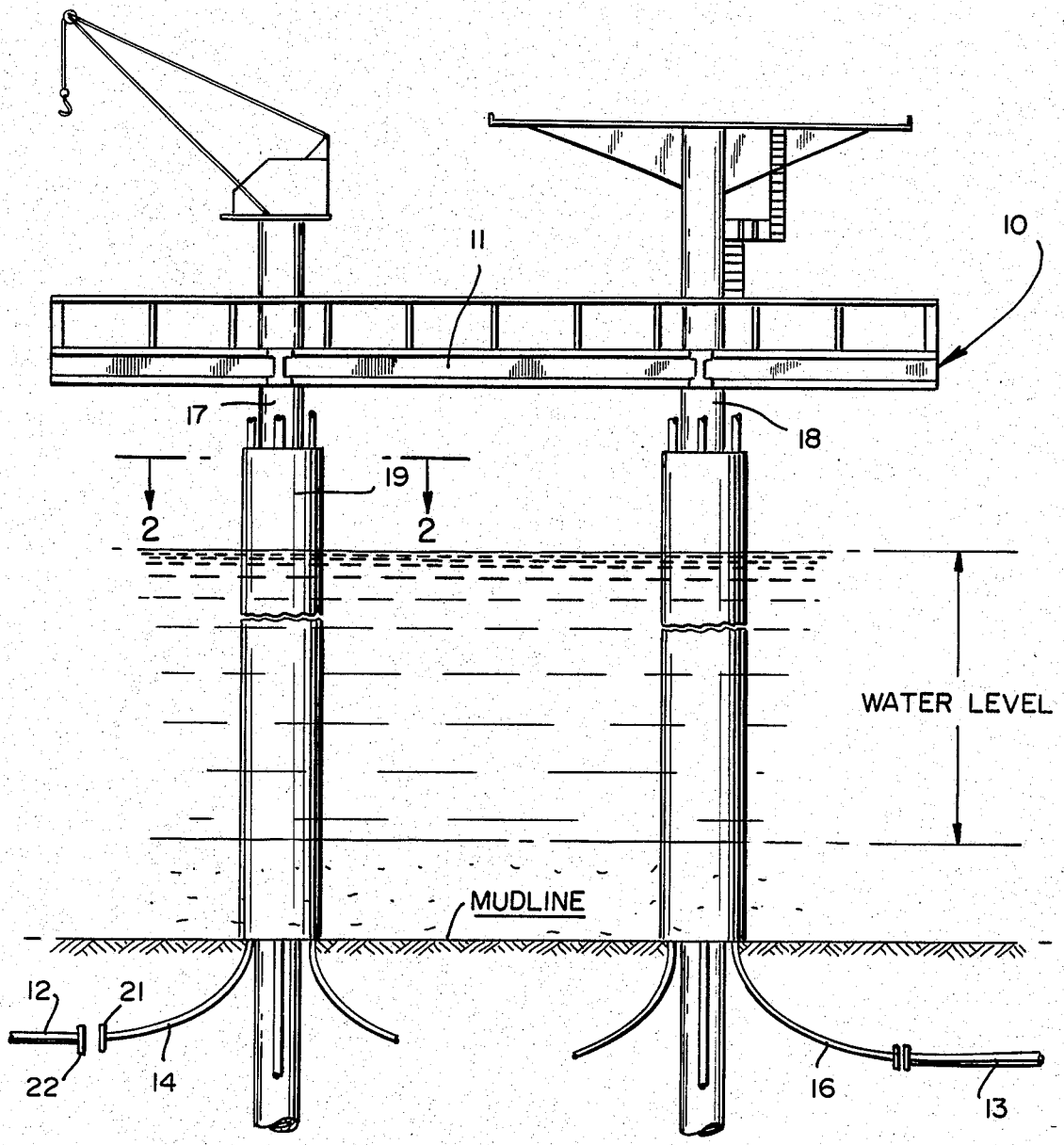
FIG. 1 is an elevation view of an offshore structure embodying the present invention.

The platform as noted can be adapted for drilling wells into the substrate therebeneath. Further, it can be adapted for gathering a number of pipelines 12 and 13 which carry hydrocarbon fluid such as crude oil or gas. In the latter instance, the various pipelines are brought to the foot of the platform.

Normally, pipelines for this purpose are buried a predetermined distance beneath the mud line. The pipelines are then connected to a plurality of conductors or risers 14 and 16 which extend externally of the respective legs 17 and 18 to deck 11. At the latter the risers are communicated with equipment for further treating the hydrocarbons prior to their being stored or being forwarded to a land installation.

Deck 11 thus can contain such equipment, although not specifically shown, as a drilling derrick, storage tanks, processing equipment and other ancillary structures. The structure is provided with at least one and preferably a plurality of downwardly extending support legs or elements 17 and 18.

These support members generally take the embodiment of an elongated steel leg, preferably of cylindrical configuration. The legs are of sufficient wall thickness to safely sustain the aggregate weight of deck 11 as well as other environmental loadings such as wind and waves.

The deck support substructure can comprise but a single leg, but usually a sufficient number of legs are utilized to adequately support deck 11 and the load it will eventually carry in the form of crude product. Said legs 17 and 18 are disposed in such a pattern as to distribute the deck load in a manner as to utilize each leg to its maximum capacity.

It should be appreciated that in some instances a plurality of support legs are more advantageous than a single leg structure. In the instance of the latter, the entire force of floating ice, when locked about and against the single leg, exerts a substantial lateral displacing force against the platform. In a platform which is supported by a plurality of smaller legs, each will be subject to a lateral force. However, because of the minimum contact area of a plurality of legs, an ice exerted force can better be distributed among all the legs.

In any instance, the presently disclosed protective sleeves 19 which are disposed about the respective legs 17 and 18, are such as to increase the leg only slightly in diameter. They do, however, afford the desired protection against floating ice and like objects.

Figure 2:
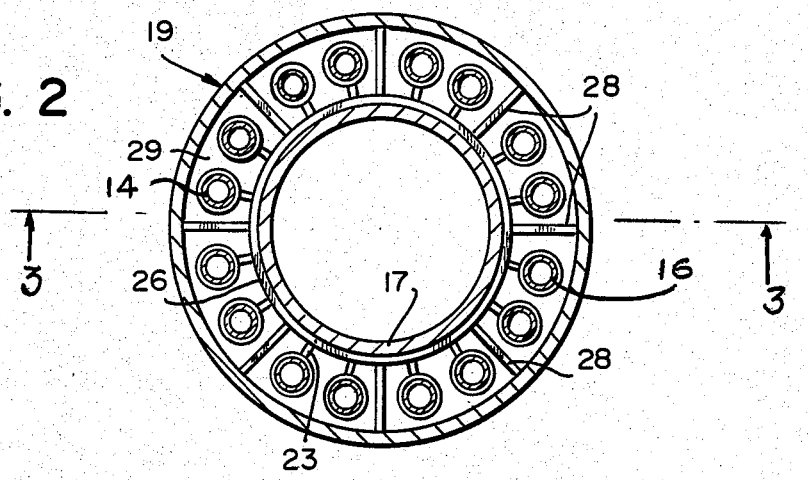
FIG. 2 is a segmentary, enlarged cross-sectional view taken along line 2—2 of FIG. 1.
Figure 3:
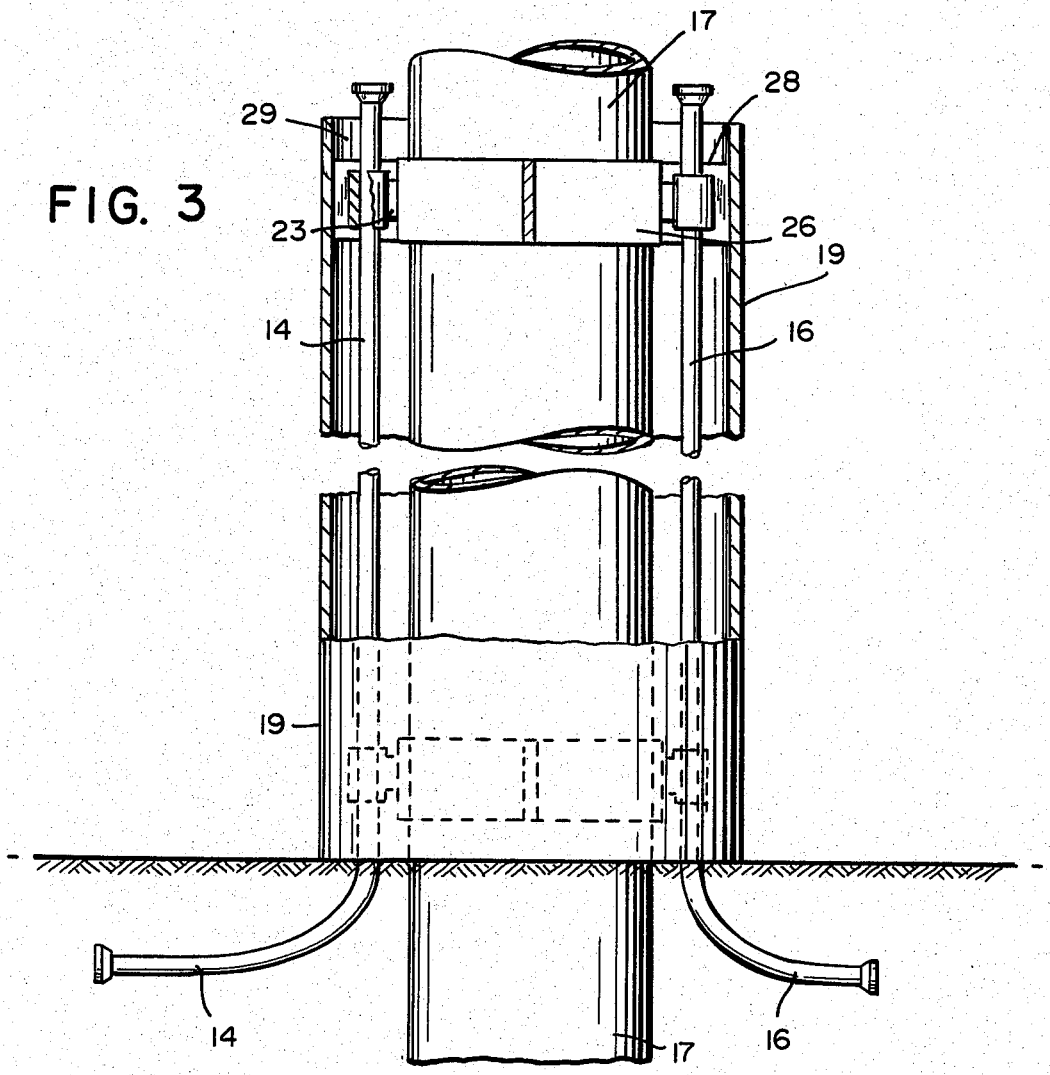
FIG. 3 is a cross-sectional view taken along line 3—3 of FIG. 2.

As shown in FIGS. 2 and 3, the respective conductors 14 and 16 which extend between deck 11 and the subsea mud line, comprise primarily a series of pipe-like conduits. The latter as previously noted, can conduct liquid or gas, or merely function as conduits for electrical cables or the like between the deck and remote well heads.

The lower ends of the respective conductors are preferably sufficiently curved to align the conductor end in a horizontal plane. In such a disposition, it can be readily connected to buried pipelines such as 12 and 13 which are laid, or drawn toward the platform 10.

To facilitate the connection between the conductor 14 and pipeline 12, both engaging members are provided with corresponding flanges 21 and 22. The latter are adapted to receive a plurality of bolts, clamps or other tightening means which will form a fluid tight joint between the connected members.

To facilitate the connection of pipeline 12 to conductor 14, the latter is disposed within the protective sleeve structure 19 to be either longitudinally or axially adjustable. Thus, each conductor such as 14 is provided with spaced apart conductor or riser clamps. The latter includes essentially at least one segment which is fixedly positioned to the protective sleeve. The other segment is removable and can be tightened about the conductor periphery to maintain the latter in a desired position.

The various conductors 14 as shown, are generally cylindrical although other cross-sectional configurations can be utilized where the need requires.

Referring to FIG. 2, protective sleeve 19 comprises primarily two cooperating members. An inner ring or circular member 26 is arranged with a diameter sufficient to be slidably registered and received along the outer surface of leg 17. Preferably, sleeve 19 can comprise a plurality of longitudinally spaced apart rings which are disposed in a manner to best be fitted about said leg 17.

Since the outer configuration of the steel leg or pile 17 is not usually uniform, ring member 26 is provided with a sufficiently large internal diameter to be slidably received along the leg in spite of irregularities in the leg surface. Preferably, the latter is contiguous with at least a portion of the ring inner wall when the ring is registered about the leg diameter.

A jacket or shell member 27 is positioned about, and spaced from inner ring 26 in a manner to define an annular space between said members. Said outer jacket 27 during normal usage, will contact and/or deflect ice or other debris which floats close to the platform. Thus the jacket 27 can be formed of a sufficiently thick, abrasion resistant metal, preferably steel, to counter any undue pressure or force which might be exerted by ice or the like.

In the instance of pack ice, the latter can extend for several feet in height in certain locations and will consequently exert a substantial and sustained lateral force against jacket 27. Further, in the instance of moving ice, the latter sometimes incorporates an abrasive element such as sand particles. Thus, any abrading action which takes place will be against jacket 27 rather than the support leg 17.

The annular space defined between jacket 27 and rings 26 is provided with a plurality of intermediate braces or radial spacers 28. The latter can extend continuously along the jacket 27 inner wall, forming longitudinal ribs, thereby providing a degree of rigidity to the unit. Alternately, spacers 28 can be arranged between the jacket and the inner ring to provide only intermittent longitudinal support therebetween.

In the instance of a plurality of inner rings 26, the intermediate braces 28 can extend either the entire length of protective sleeve 19 or merely constitute a relatively short support member.

In either event the intermediate braces 28 define a plurality of peripheral compartments 29 between the respective rings. Each compartment is of sufficient size to receive at least one conductor 14, and preferably a plurality thereof which extend the length of the leg 17 as herein noted.

In the instance of a jacket 27 having a continuous elongated inner ring 26, the intermediate radially spaced compartments 29 extend for the entire length of the protective sleeve 19.

Referring to FIG. 3, inner ring 26 supports the various conductor clamps 23 which, as shown, are fastened to and depend outwardly from the ring 26 outer surface at a welded joint. In one embodiment, a removable clamp member can be aligned in place to tightly secure conductor 14 between two said members by bolts or similar means.

To best position the protective sleeve 19, normally the legs or piles 17 are initially driven into the substrate at a chosen offshore site in a pattern to define the deck support substructure. Thereafter, and prior to deck 11 being lowered into place to engage the upper ends of the various legs 17 and 18, protective sleeve 19 is lowered along the length of the leg to a desired depth. This fitting permits sleeve 19 to be adjusted longitudinally along the leg and be most effectual with respect to encountering floating ice.

In an alternate embodiment of the invention, protective sleeve 19 can comprise a split member which, although not presently shown, is formed in two cooperating halves. The latter are joined only after they have been fitted to leg 17. Thus, the respective protective sleeve members are fabricated in corresponding semicircular or mating halves and positioned onto the leg through use of bolts, or bands or other means to connect the respective sleeve halves one to the other.

After being located, sleeve 19 is fixedly assembled in place to the leg 17 by welding or bolting.

Although modifications and variations of the invention may be made without departing from the spirit and scope thereof, only such limitations should be imposed as are indicated in the appended claims.

We claim:

1. The combination with a marine structure positioned at an offshore body of water which is exposed to floating ice and which structure comprises a deck having operating equipment carried thereon to receive flows of fluid from a point remote from the marine structure, at least one elongated support leg means (17) extending substantially uprightly through said body of water and supportably engaging said deck to fixedly dispose the latter a predetermined distance above the water's surface, of;

a non-load bearing protective sleeve (19) removably engaging and being dependent from said elongated support means leg, and surrounding at least a portion of the length thereof which is exposed to contact with ice and other flotsam on the water's surface, said protective sleeve (17) including an elongated shell (27) which is spaced outwardly from and depends from at least one inner ring (26), the latter being disposed contiguous with the external surface of said elongated leg support means, and being longitudinally adjusted along said leg prior to being fastened to the latter.

2. In the apparatus as defined in claim 1, wherein said at least one inner ring is longitudinally positioned along the peripheral surface of said elongated leg and fastened in place when said protective shield is in the desired position relative to the surface of the body of water.

3. In the apparatus as defined in claim 1, including a plurality of radially disposed spacers fixedly positioning said shell (27) with respect to the inner ring and defining a plurality of peripherally spaced compartments between adjacent spacers.

4. In the apparatus as defined in claim 3, including conductor means spaced from said outer shell disposed within said peripherally spaced compartments and extending substantially the length of said protective sleeve (19).

5. In the apparatus as defined in claim 4, wherein said protective sleeve extends substantially for the distance between said deck and the mud line of said body of water.

6. In the combination as defined in claim 1, wherein said at least one inner ring includes a plurality of said rings which are longitudinally spaced, and registered on said elongated leg.

7. In the combination as defined in claim 3, wherein said radially disposed spacers extend longitudinally of said sleeve.

* * * * *